US007121882B2

(12) United States Patent
Tamura et al.

(10) Patent No.: US 7,121,882 B2
(45) Date of Patent: Oct. 17, 2006

(54) ELECTRICAL CONNECTING DEVICE FOR CONNECTING TO A MATING DEVICE

(75) Inventors: Nobuo Tamura, Akita (JP); Tsuyoshi Osada, Aichi (JP)

(73) Assignees: Mitsumi Electric Co., Ltd., Tokyo (JP); J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 11/101,158

(22) Filed: Apr. 7, 2005

(65) Prior Publication Data

US 2005/0239341 A1 Oct. 27, 2005

(30) Foreign Application Priority Data

Apr. 7, 2004 (JP) ..... 2004-112895

(51) Int. Cl.
*H01R 9/05* (2006.01)

(52) U.S. Cl. ..... 439/582; 439/468; 439/881; 439/902

(58) Field of Classification Search ..... 439/582, 439/686, 687, 689, 682, 455, 460, 466, 468, 439/731, 902, 854, 855
See application file for complete search history.

(56) References Cited

U.S. PATENT DOCUMENTS 3,745,515 A * 7/1973 Michaels ..... 439/651
4,017,141 A * 4/1977 Bury et al. ..... 439/596
6,621,688 B1 * 9/2003 Burdick ..... 361/627
6,666,708 B1 * 12/2003 Saito ..... 439/466
6,905,371 B1 * 6/2005 Yi-Tse ..... 439/660

* cited by examiner

*Primary Examiner*—Hae Moon Hyeon
(74) *Attorney, Agent, or Firm*—Osha Liang LLP

(57) ABSTRACT

An electrical connecting device is described adapted to be connected to a mating housing element that supports mating terminals of at least four poles that are arranged in a parallel manner in rectilinear form. The device includes connection terminals of at least four poles adapted to be respectively electrically connected to the mating terminals. The connection terminals include terminal connecting parts for connection to the mating terminals, the terminal connecting parts being arranged along a terminal connecting direction, and wire connecting parts each connected at a first end thereof to a respective wire and at a second end thereof to a respective terminal connecting part so as to form a bent connection there between. Also included is a housing element which has terminal supporting parts for supporting each of the connection terminals in a manner where the terminal connecting parts are arranged in a parallel manner in rectilinear form corresponding to the mating terminals, and wire supporting parts for supporting each of the respective wires such that the wires are arranged in a direction parallel to the terminal connection direction, the connecting housing element being adapted to engage with the mating housing element.

8 Claims, 10 Drawing Sheets

ELECTRICAL CONNECTING DEVICE FOR CONNECTING TO A MATING DEVICE

TECHNICAL FIELD

The present invention relates to an electrical connecting device that is connected to a mating-housing element, which supports mating terminals of four or more poles which are arranged in a parallel manner in rectilinear form.

BACKGROUND ART

An electrical connecting device that is connected to a mating housing element, which supports mating terminals of four or more poles which are arranged in a parallel manner in rectilinear form has been conventionally known. Japanese Published Unexamined Patent Application H11-251002, for example, discloses a coaxial connector having a number of cores which is formed of a plug connecting part and a receptacle connecting part as a connector that includes the above-described electrical connecting device. In this coaxial connector, the plug coupling part is provided with four poles of the first central contacts and the first external contacts, and these four pole contacts are arranged in a parallel manner in rectilinear form. Meanwhile, in the receptacle coupling part, four pole second central contacts and second external contacts which are respectively electrically connected to the four pole contacts on the plug coupling part side are arranged in a parallel manner in rectilinear form, at points which respectively correspond to the four pole contacts on the plug coupling part side. Thus, four coaxial cables which correspond to and are connected to the respective contacts lead out in a straight line on the side opposite the side where the four pole contacts on either side, the plug coupling part side or the receptacle coupling part side, are respectively connected in the arrangement.

In the coaxial connector that is described in Japanese Published Unexamined Patent Application H11-251002, however, the coaxial cable that leads out from either housing element on the plug coupling part side or the receptacle coupling part side is arranged so as to lead out in a straight line in the direction perpendicular to the direction in which each housing element is aligned in a parallel manner. Therefore, in either housing element, the size of the housing element may become too large, depending on the pitch between the poles which are arranged in a parallel manner.

Accordingly, there is some spatial restriction, due to the size of the housing elements when each connector is worked on so as to be connected. That is, it is extremely inconvenient to work on a connection within a limited space or through such a space, like work in a narrow space.

This is extremely inconvenient particularly in the case where a mating housing element that supports mating terminals of four or more poles which are arranged in a parallel manner in a rectilinear form, and an electrical apparatus having a mating housing element that supports connection terminals of four or more poles which are respectively electrically connected to each of the mating terminals are connected to each other after this electrical connecting device has been inserted into a hole that is provided in a wall. That is, the size of the electrical connecting device that is inserted into a hole provided in a wall restricts the size of this hole, or makes the work of insertion of the electrical connecting device difficult.

DISCLOSURE OF THE INVENTION

In view of the above-described situation, an object of the present invention is to provide a compact electrical connecting device that can reduce the inconvenience of the dimensional restriction in the case where a mating housing element that supports mating terminals of four or more poles which are arranged in a parallel manner in rectilinear form and an electrical connecting device having a connecting housing element that supports connection terminals of four or more poles which are respectively electrically connected to each of the mating terminals are connected to each other.

The present invention relates to an electrical connecting device that is connected to a mating housing element that supports mating terminals of four or more poles which are arranged in a parallel manner in rectilinear form.

Thus, the electrical connecting device according to the present invention is characterized by several points, as described above, in order to achieve the above-described object. That is, the present invention has any of the below described characteristics, either by themselves or in an appropriate combination.

In order to achieve the above-described object, the electrical connecting device according to the present invention is firstly characterized by being provided with: connection terminals of four or more poles which are respectively electrically connected to the above-described mating terminals of four or more poles, wherein the connection terminals of four or more poles respectively having terminal connecting parts which are connected to the above-described mating terminals, wire connecting parts which are connected to wires at the ends on the side opposite the terminal connecting parts, and bent parts which are formed so as to be bent between the terminal connecting parts and the wire connecting parts; and a connecting housing element which has terminal supporting parts for supporting each of the above-described connection terminals in a manner where the above-described terminal connecting parts are arranged in a parallel manner in rectilinear form so as to be respectively connected to the above-described mating terminals, and a wire supporting part for supporting each of the wires in a manner where wires that are connected to the above-described wire connecting parts are arranged in the direction parallel to the direction in which the above-described terminal connecting parts are arranged in rectilinear form, and which is engaged with and connected to the above-described mating housing element.

In this configuration, the bent parts are formed in the connection terminals between the terminal connecting parts and the wire connecting parts, in a manner where wires that are connected to the wire connecting parts are arranged in the direction parallel to the direction in which the terminal connecting parts are arranged in rectilinear form. As a result of this, the wires, each of which runs parallel to the rest, can be arranged so as to be bundled, and the space for arranging the wires can be reduced. That is, an increase in the size of the electrical connecting device caused by the pitch of the terminal connecting parts that are arranged in a parallel manner can be largely avoided, and thus, miniaturization of the electrical connecting device can be achieved. As a result of this, it becomes convenient to work on a connection within a limited space or through such a space, like work in a narrow space. In addition, the electrical connecting device is in a form which extends for a great length in the direction in which the terminal connecting parts are arranged in rectilinear form, and therefore, it becomes very convenient, in the case where the electrical connecting device is connected after it has been inserted into a hole provided in a wall. That is, the size of this hole can be reduced, or the work of inserting the electrical connecting device can be easily carried out. Accordingly, a compact electrical connecting device can be provided, where inconvenience caused by the dimensional restriction can be reduced in the case where a mating housing element that supports mating terminals of four or more poles which are arranged in a parallel manner in rectilinear form and an electrical connecting device having a connecting housing element that supports connection terminals of four or more poles which are respectively electrically connected to each of the mating terminals are connected to each other.

The electrical connecting device according to the present invention is secondly characterized in that the above-described bent parts are formed so as to be bent in a right angle.

In this configuration, the distance between the line along which the terminal connecting parts are arranged in a parallel manner and a wire that is connected to a wire connecting part and arranged parallel to this line can be reduced. That is, the form that extends in the direction in which the terminal connecting parts are arranged can be narrowed, and thereby, the electrical connecting device can be miniaturized.

The electrical connecting device according to the present invention is thirdly characterized in that the above-described wire supporting parts are formed in a manner where the cross sections of the portions of the respective wires that are connected to the above-described wire connecting parts which are supported by the above-described wire supporting parts are arranged so as to be stacked in step form, where the upper step is on the side opposite the side where the above-described terminal connecting parts are arranged in the above-described connecting housing element, and thereby, the respective wires are supported by the above-described connecting housing element.

In this configuration, the wires which are connected to the wire connecting parts and arranged in a parallel manner are arranged in such a manner that the cross sections thereof are stacked in step form, and therefore, the wires, each of which is parallel to the rest, can be arranged more closely, so as to be bundled, and thus, the space where the wires are arranged can be reduced. That is, the electrical connecting device can be prevented from spreading in the direction of the width of the arrangement of the terminal connecting parts, and miniaturization of the electrical connecting device can be achieved.

The electrical connecting device according to the present invention is fourthly characterized in that the above-described connection terminals which are connected to the wires arranged on the upper step side of the above-described stacked arrangement in step form are supported by the above-described terminal supporting parts so as to be located on the upper step side of the above-described connection terminals that are connected to the wires arranged on the lower step side, thus forming a step.

In this configuration, the connection terminals that are connected to the wires arranged on the upper step side are supported in such a position so as to form a step on top of the wires on the lower step side. Therefore, the curvature that occurs in the wires on the upper step side when the portion between the portion that is connected to the wire connecting parts and the portion that passes above the wires on the lower step side is bent can be reduced, and thus, the occurrence of damage or the like to the wire that is arranged on the upper step side can be prevented.

The electrical connecting device according to the present invention is fifthly characterized in that the above-described wire supporting parts are formed in a manner where the cross sections of the respective wires that are connected to the above-described wire connecting parts which are supported by the above-described wire supporting parts are arranged in chevron form, and are respectively positioned in grid form, and thus, the respective wires are supported.

In this configuration, the wires which are connected to the wire connecting parts and arranged in a parallel manner can be supported and arranged in a manner where the cross sections thereof are stacked in step form, arranged in chevron form and positioned in grid form. Therefore, the wires on the upper step side can be supported as they are, by extending the wire supporting parts on the lower step side upward, and the structure of the wire supporting parts can be simplified, in the case where the wires are stacked in step form. In addition, the wires can be prevented from spreading in the direction of the width relative to the direction in which the terminal connecting parts are arranged on the upper step side, and miniaturization of the electrical connecting device can be achieved.

The electrical connecting device according to the present invention is sixthly characterized in that the above-described wire supporting parts are formed as a number of protrusions which are provided so as to protrude from the above-described connecting housing element and support a wire that is engaged between a pair of protrusions from among the number of protrusions which are positioned so as to face each other.

In this configuration, a plurality of protrusions are provided to the connecting housing element, and a wire can be supported simply by engaging the wire between a pair of protrusions that face each other, and therefore, the wire supporting parts can be easily formed.

The electrical connecting device according to the present invention is seventhly characterized in that the portions of the above-described protrusions which make contact with wires that are to be connected to the above-described wire connecting parts on the peripheral side of these protrusions are formed in a smoothly curved form.

In this configuration, the portion of a protrusion that makes contact with a wire is formed in a smoothly curved form, and therefore, damaging of a wire at the portion that makes contact can be prevented.

The electrical connecting device according to the present invention is eighthly characterized by being used as an electrical connecting device that is connected to the above-described mating housing element after being inserted into a hole that is provided for the insertion of wires between the inside and outside of an automobile.

In this configuration, the electrical connecting device can be easily inserted into a hole that is provided for the insertion of wires between the inside and outside of an automobile, and in addition, the size of this hole can be reduced.

Here, the above-described and other objects, features and advantages of this invention will be clarified by reading the following description together with the attached drawings.

BEST MODE FOR CARRYING OUT THE INVENTION

In the following, the best mode for carrying out the present invention is described with reference to the drawings. Here, although, according to the present mode, an electrical connecting device that is connected to a mating housing element which supports mating terminals of four poles (four pieces) is described, the present invention is applicable in the case where there are five poles or more. That is, the present invention can be widely applied to an electrical connecting device that is connected to a mating housing element which supports mating terminals of four or more poles which are aligned in a line.

In addition, the present invention is particularly suitable for use in a case where an electrical connecting device is connected to a mating housing element after being inserted into a hole that is provided for the insertion of wires between the inside and outside of an automobile, and the present mode is described by citing this application as an example. However, the present invention is applicable even in the case where an electrical connecting device is used differently from this application, and can be applied for broader use. That is, the present invention can be applied in a variety of environments and for a variety of purposes.

Figure 1:
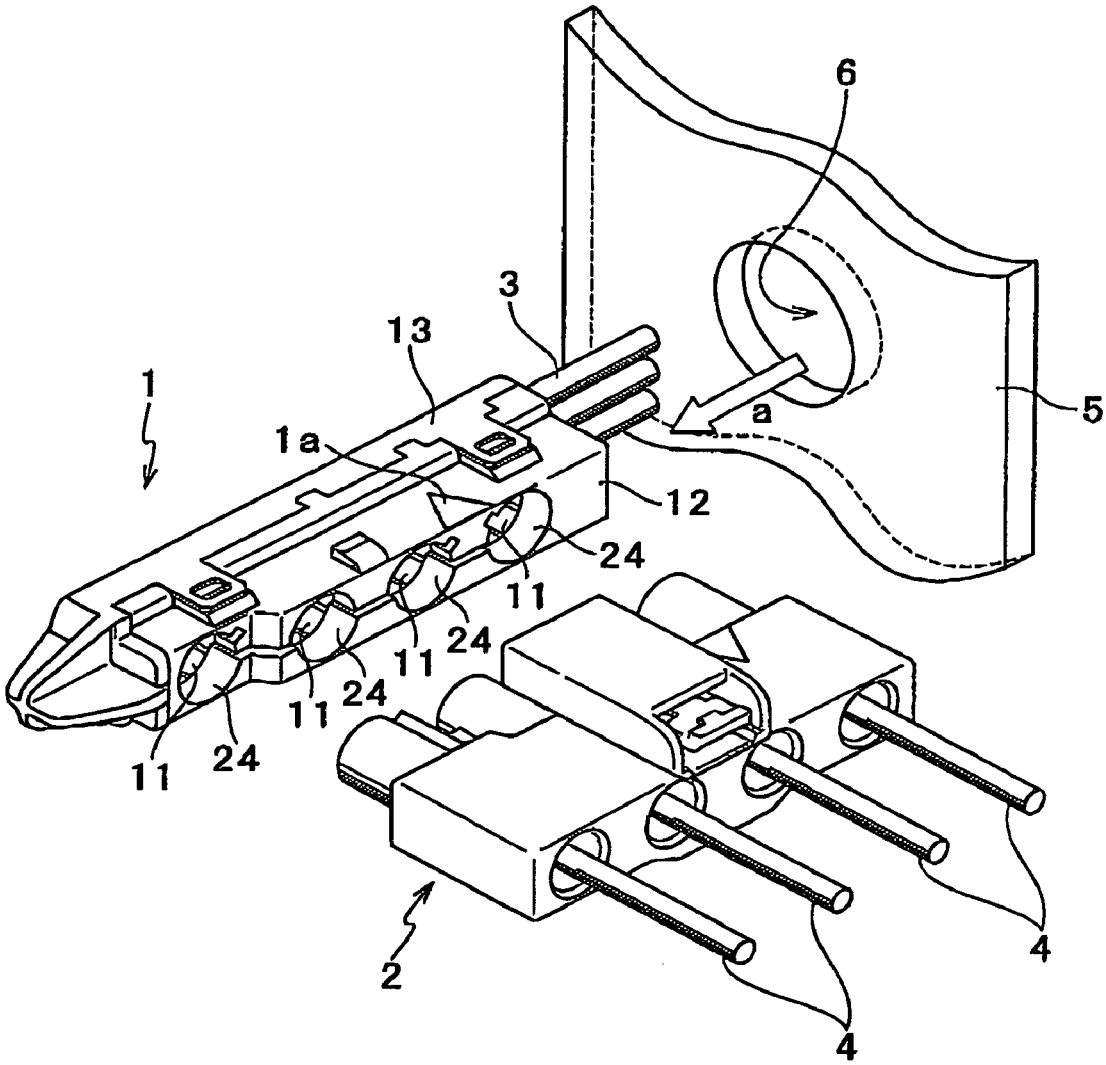
FIG. 1 is a perspective view illustrating an electrical connecting device according to one embodiment of the present invention and a mating housing element that is connected to this electrical connecting device.

FIG. 1 is a perspective view illustrating a mating housing element 2 which is connected to coaxial wires 4 (hereinafter referred to as wires 4) of four poles (four wires), as well as an electrical connecting device 1 according to the present embodiment, which is connected to coaxial wires 3 (hereinafter referred to as wires 3) of four poles (four wires), and is connected to mating housing element 2 (here, in this perspective view, only three wires 3 are shown). Electrical connecting device 1 and mating housing element 2 are used as relay connectors that are utilized in a variety of complex antennas which are attached to automobiles, such as, for example, an AM/FM antenna, a cellular antenna, a GPS (Global Positioning System) antenna, an SDARS (Satellite Digital Audio Radio System) antenna, an ETC antenna and a VICS antenna.

Figure 2:
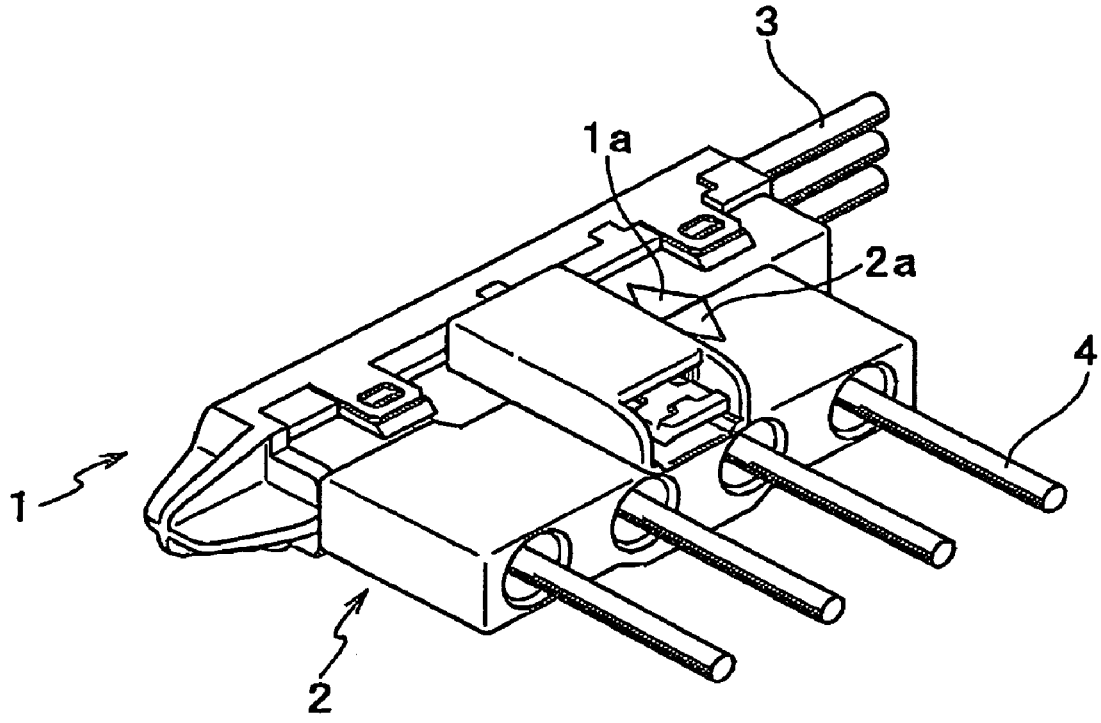
FIG. 2 is a perspective view showing the state where the electrical connecting device and the mating housing element shown in FIG. 1 are connected to each other.

Thus, electrical connecting device 1 is inserted into a roof hole 6 that is provided in a roof 5 of an automobile of which a portion is shown in FIG. 1 in the direction of arrow a, and after that, is connected to mating housing element 2. As a result of this, the state is gained where wires 3 and wires 4 pass through roof hole 6 between the inside and outside of the automobile and are electrically connected to each other via connectors (1 and 2). In addition, as shown in the perspective view of FIG. 2, electrical connecting device 1 and mating housing element 2 are connected to each other. Here, mark 1*a* (triangular mark) is attached to electrical connecting device 1, and mark 2*a* (triangular mark) is attached to mating housing element 2. These marks (1*a* and 2*a*) are attached so that the positions thereof match when electrical connecting device 1 and mating housing element 2 are appropriately connected to each other, and whether or not an appropriate connection has been made can be confirmed from whether or not the connection is made in the state where the positions of the two marks (1*a* and 2*a*) match.

Figure 3:
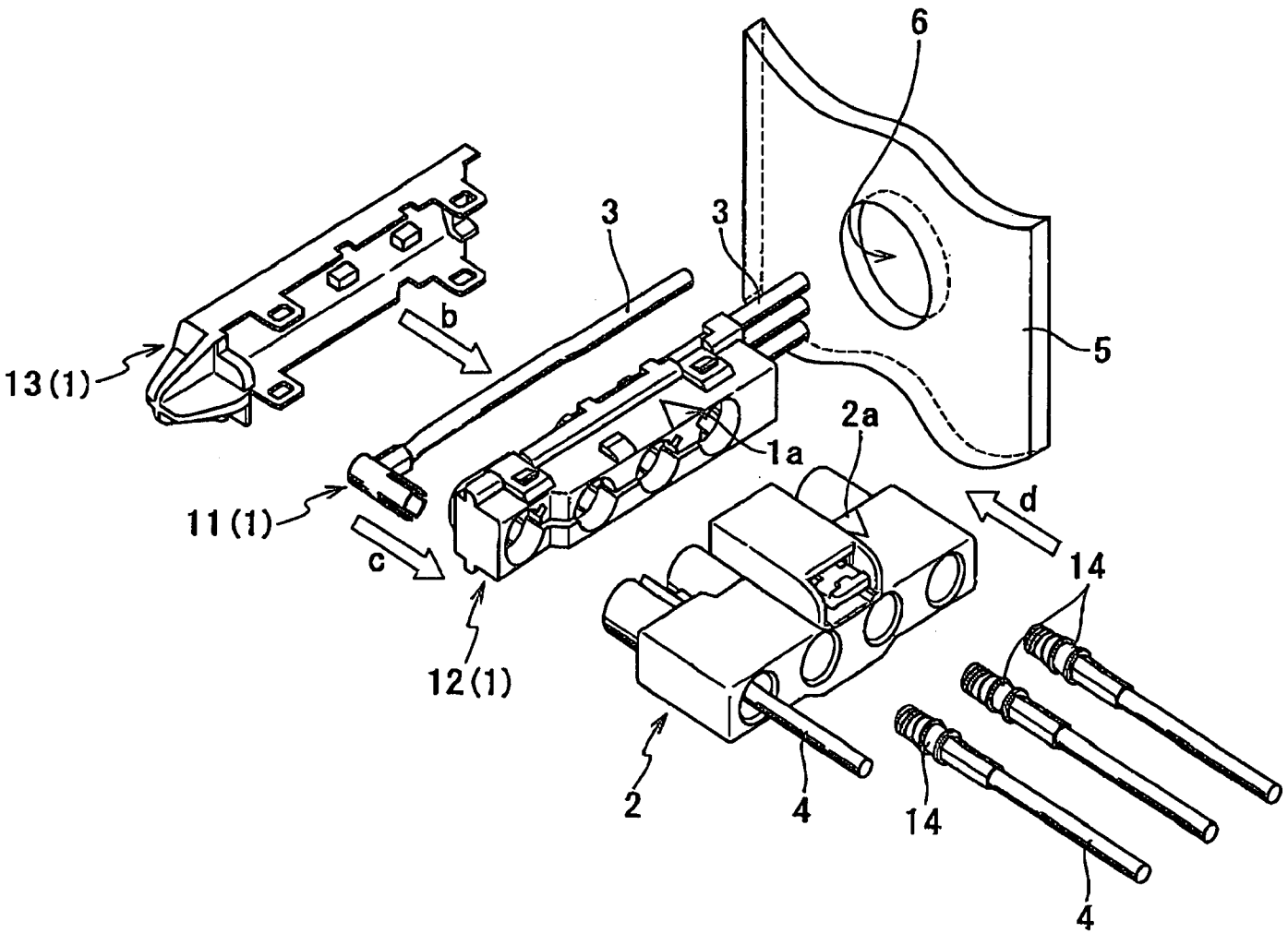
FIG. 3 is an exploded perspective view showing the electrical connecting device and the mating housing element shown in FIG. 1.

FIG. 3 is an exploded perspective view showing electrical connecting device 1 and mating housing element 2. Electrical connecting device 1 is provided with connection terminals 11 of four poles (four pieces) which are respectively connected to the ends of four wires 3, a connecting housing element 12 which is engaged and connected to mating housing element 2, and a cover element 13 which is attached to mating housing element 12. Connection terminals 11 in the state of being connected to wires 3 are engaged in the direction of arrow c in the figure and respectively supported by connecting housing element 12. In addition, cover element 13 is engaged in the direction of arrow b in the figure and attached to connecting housing element 12 so as to cover connection terminals 11. Here, mating terminals 14 which are respectively connected to wires 4 are engaged in the direction of arrow d in the figure and respectively supported by mating housing element 2.

Figure 4:
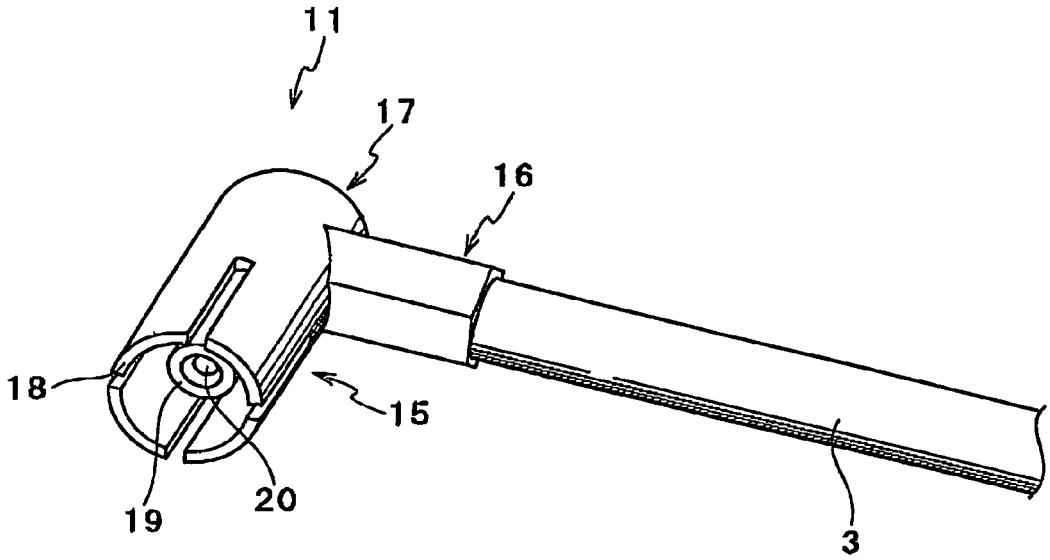
FIG. 4 is a perspective view of a connection terminal shown in FIG. 3.

Connection terminals 11 are respectively electrically connected to mating terminals 14 at the same time as the connection between electrical connecting device 1 and mating housing element 2. Such a connection terminal 11, as shown in the perspective view of FIG. 4, is provided with a terminal connecting part 15, a wire connecting part 16 and a bent part 17. Terminal connecting part 15 has an outer shell 18, an isolator 19, a center terminal 20 and the like, and is formed for a coaxial wire. In addition, this terminal connecting part 15 makes contact with and is connected to a connected terminal 14. In addition, wire connecting part 16 is caulked and connected to a wire 3 at the end on the side opposite terminal connecting part 15. In addition, bent part 17 is a part between terminal connecting part 15 and wire connecting part 16, and is formed so as to be bent in a right angle.

Figure 5:
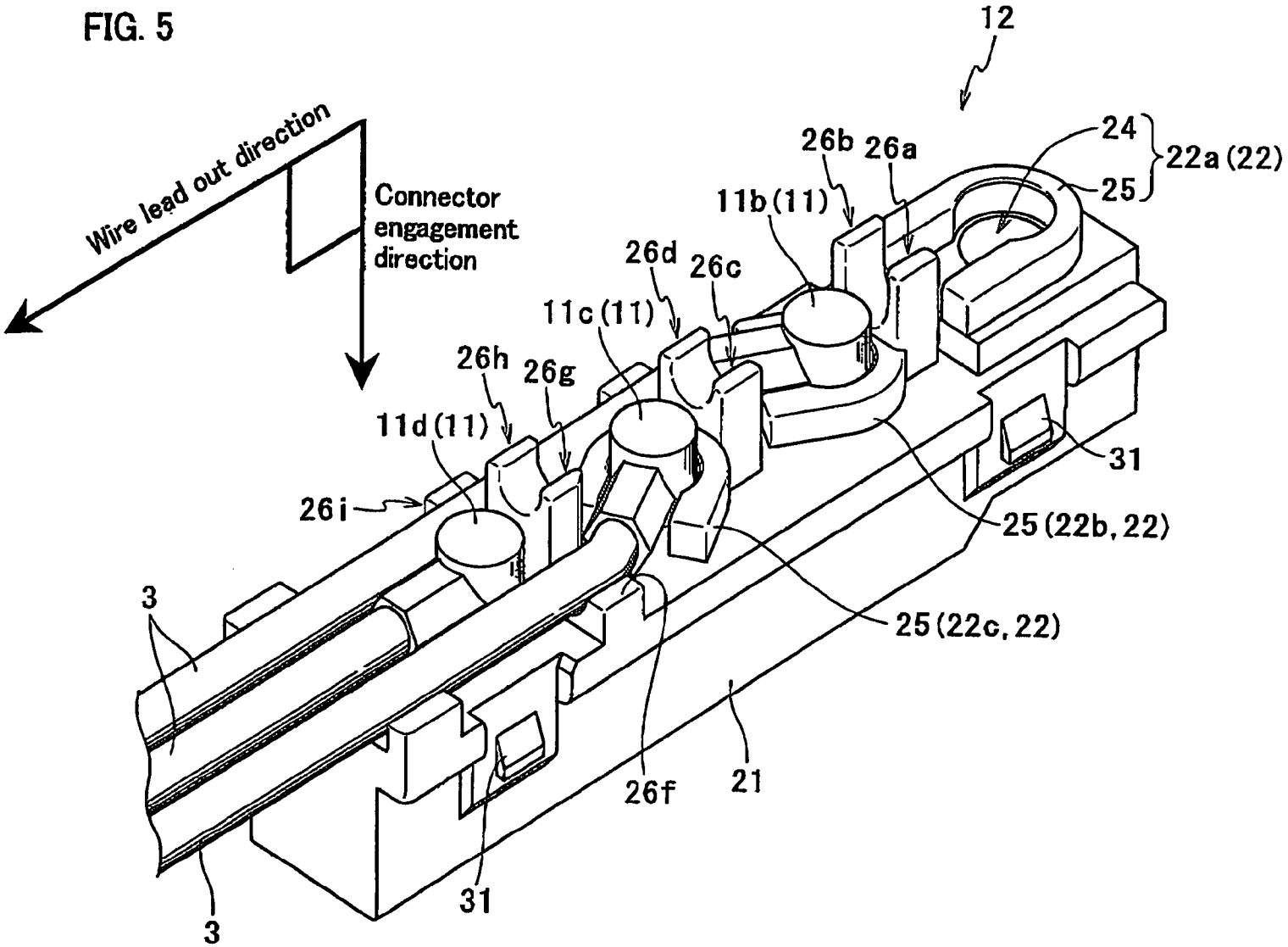
FIG. 5 is a perspective view showing the connecting housing element shown in FIG. 3.

FIG. 5 is a perspective view showing connecting housing element 12, and shows the state where connection terminals 11 (11*b* to 11*d*) of three poles which have been connected to wires 3 are attached to connecting housing element 12 (the state where only connection terminal 11*a* shown in FIG. 6 is not attached). Connecting housing element 12 has a body portion 21 that is formed in long parallelepiped form, and terminal supporting parts 22 and wire supporting parts 23 are formed on this body portion 21.

Terminal supporting parts 22 are provided in four places so as to respectively support connection terminals 11 of four poles, and FIG. 5 shows the manner in which connection terminal 11*b* is supported by terminal supporting part 22*b* and connection terminal 11*c* is supported by terminal supporting part 22*c*. These terminal supporting parts 22 are provided to support respective connection terminals 11 so that respective terminal connecting parts 15 of respective connection terminals 11 are aligned in rectilinear form. As a result of this, respective connection terminals 11 are connected to respective mating terminals 14 on the mating housing element 2 side. In addition, each terminal supporting part 22 has an engagement hole 24 and a positioning part 25 as a terminal supporting part 22*a* shown in FIG. 5. Engagement hole 24 is created so as to penetrate the body portion, and terminal connecting part 15 of a connection terminal 11 is engaged in this engagement hole 24. In addition, positioning part 25 is provided in a wall form which partially surrounds terminal connecting part 15 and wire supporting part 16 in the state where terminal connecting part 15 has been engaged in engagement hole 24, and allows the direction of connection terminal 11 that is supported by wire supporting part 22 to be fixed (to be positioned). Here, as shown in FIG. 1, engagement hole 24 opens on the bottom side of connecting housing element 12 (on the side that is engaged with mating housing element 2), and terminal connecting part 15 of each connection terminal 11 is supported in the state where it is exposed within this engagement hole 24. In addition, connection terminals 11 are in the state where they are aligned in a line, in a manner where each connection terminal 11 is connected to each connected terminal 14.

Figure 6A:
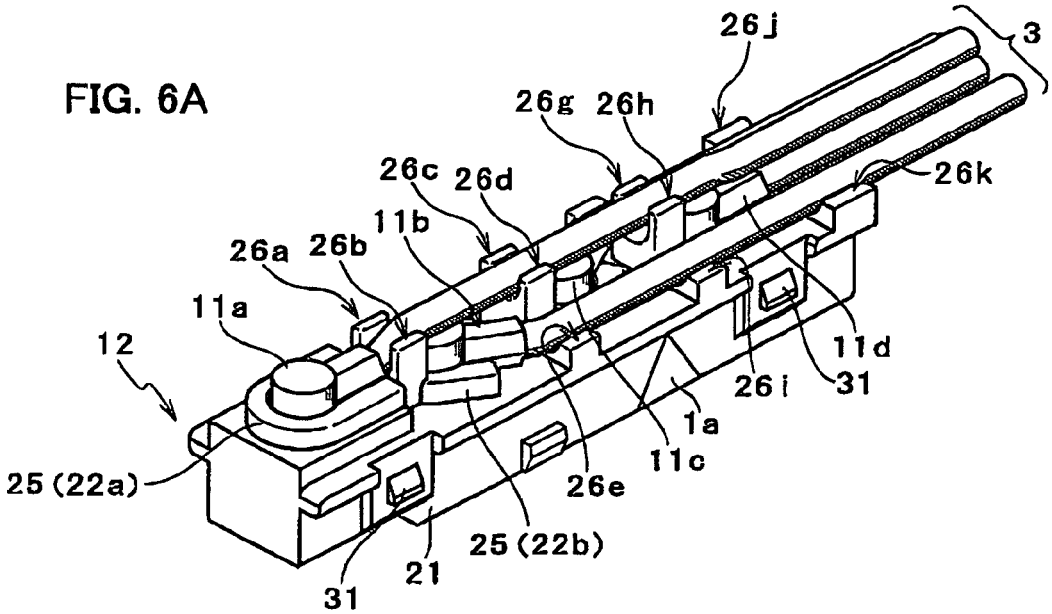
FIG. 6A is a perspective view showing the connecting housing element as viewed from the side opposite that of FIG. 5.
Figure 6B:
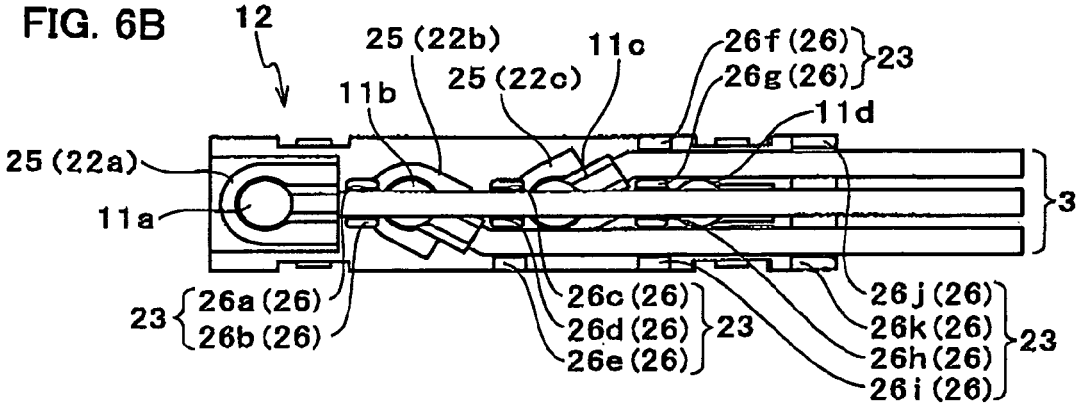
FIG. 6B is a plan view showing the connecting housing element shown in FIG. 6A.
Figure 6C:
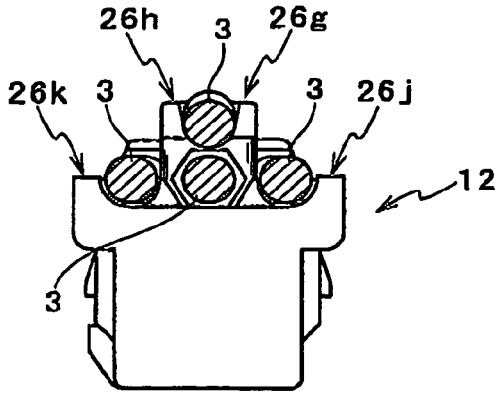
FIG. 6C is a side view showing the connecting housing element as viewed from the right side of FIG. 6B.

FIG. 6 are a perspective view showing connecting housing element 12 as viewed from the side opposite that of FIG. 5 (FIG. 6A), a plan view thereof (FIG. 6B) and a side view as viewed from the right side of FIG. 6B (FIG. 6C). Here, FIG. 6 show the state where all connection terminals 11 of four poles to which wires 3 have been connected are attached to connecting housing element 12.

As shown in FIG. 5 and FIG. 6, wire supporting parts 23 support respective wires 3 so that wires 3 which are connected to wire connecting parts 16 of connection terminals 11 are placed in the direction parallel to the direction in which terminal connecting parts 15 are arranged in rectilinear form. These wire supporting parts 23 are formed as a number of protrusions 26 (26*a* to 26*k*) which are provided so as to protrude from connecting housing element 12. In addition, a wire 3 is engaged between a pair of protrusions 26 and 26, from among the number of protrusions 26, which are positioned so as to face each other, and thereby, wire 3 is stably supported. That is, wire 3 which is connected to connection terminal 11*a* is engaged between the respective pairs of protrusions 26 and 26 which are positioned so as to face each other (between 26*a* and 26*b*, between 26*c* and 26*d*, and between 26*g* and 26*h*), and thereby, is supported. In the same manner, wire 3 that is connected to connection terminal 11*b* is engaged between the respective pairs of protrusions 26 and 26 which are placed so as to face each other (between 26*d* and 26*e*, and between 26*h* and 26*i*), and thereby, is supported, and wire 3 that is connected to connection terminal 11*c* is engaged between the pair of protrusions 26 and 26 which are positioned so as to face each other (between 26*f* and 26*g*), and thereby, is supported. Thus, the respective protrusions 26 are provided so that the respective positions of the wires 3 can be supported by wire supporting parts 23 in the direction parallel to the direction in which terminal connecting parts 15 are arranged in rectilinear form.

As described above, the positions of respective wires 3 can be fixed in connecting housing element 12 so that respective wires 3 can lead out in the direction parallel to the direction in which terminal connecting parts 15 are arranged in rectilinear form, that is, in the direction perpendicular to the direction in which the connector is engaged (see FIG. 5). Thus, the positions of wires 3 are fixed, and thereby, dispersion of electrical wave interference properties among wires 3 (dispersion of electrical wave interference properties among units of electrical connecting device 1 as products) can be reduced. Here, in the case where connection terminals 11 and wires 3 are attached to connecting housing element 12 in an inappropriate manner, that is, in the case where wires 3 are not arranged along wire supporting parts 23, the structure does not allow the below described cover element 13 to be appropriately attached to connecting housing element 12, due to interference by protrusions 26 and wires 3. Therefore, in the case where electrical connecting device 1 is assembled in an incorrect manner, whether or not assembly has been appropriately carried out can be confirmed from whether or not cover element 13 can be appropriately attached to connecting housing element 12.

Figure 7:
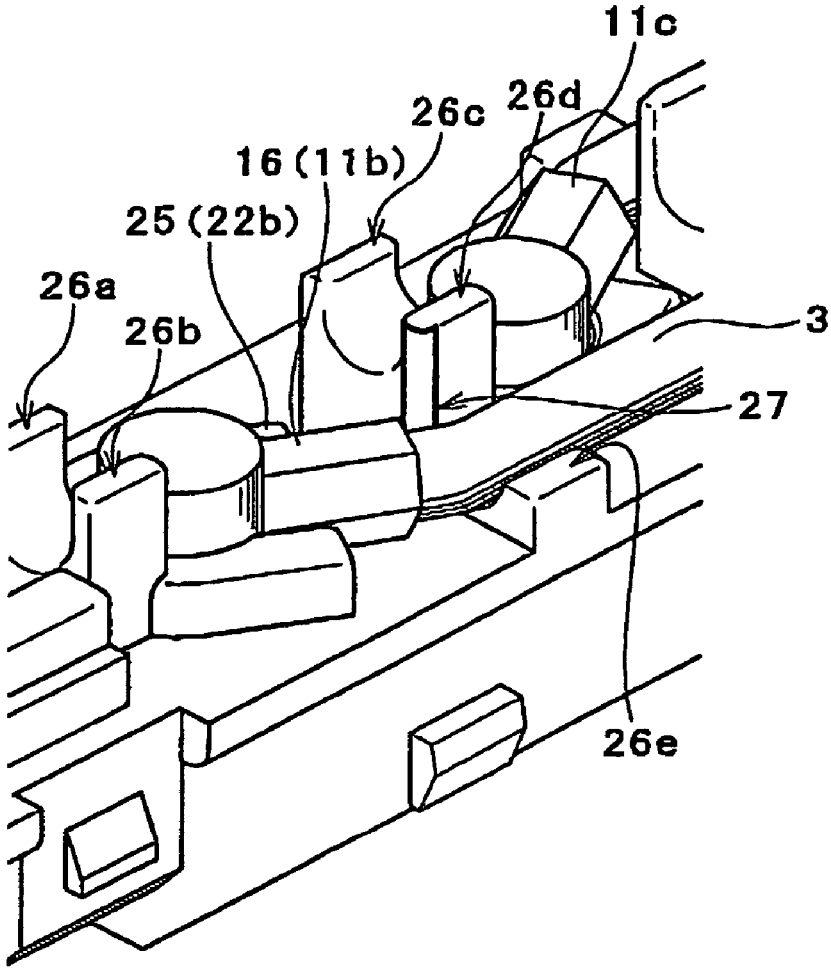
FIG. 7 is an enlarged perspective view showing a portion of the connecting housing element as viewed in the same direction as that of FIG. 6A.

Here, FIG. 7 is a perspective view showing an enlarged portion of connecting housing element 12 as viewed from the same direction as in FIG. 6A, and shows the state where wire 3 that is connected to connection terminal 11*a* is not attached. As shown in FIG. 7, the portion of protrusion 26*c* which makes contact with wire 3 that is connected to wire connecting part 16 of connection terminal 11*b* on the side surrounding the protrusion (wire contacting portion 27 surrounded and indicated by a frame line) is formed so as to have a smoothly curved surface. Wire contacting portion 27 is formed so as to have a smoothly curved surface in this manner (R portion is formed), and thereby, wire 3 can be prevented from being damaged by this contacting portion. In particular, the performance of a coaxial wire for high frequency is easily deteriorated (VSWR) when bent, and the occurrence of such deterioration in performance can be prevented.

In addition, as shown in FIG. 6, wire supporting parts 23 support respective wires 3 in a manner where cross sections of the portions of respective wires 3 that are connected to wire connecting parts 16, which are supported by these wire supporting parts 23, are stacked in step form, where the upper step is located toward the side opposite the side on which terminal connecting parts 15 are arranged in connecting housing element 12. Thus, as shown in FIG. 6C, wire supporting part 23 in this portion supports respective wires 3 in a manner where the cross sections of the portions of respective wires 3 which are supported by this wire supporting part 23 are arranged in chevron form and positioned in grid form.

Figure 8:
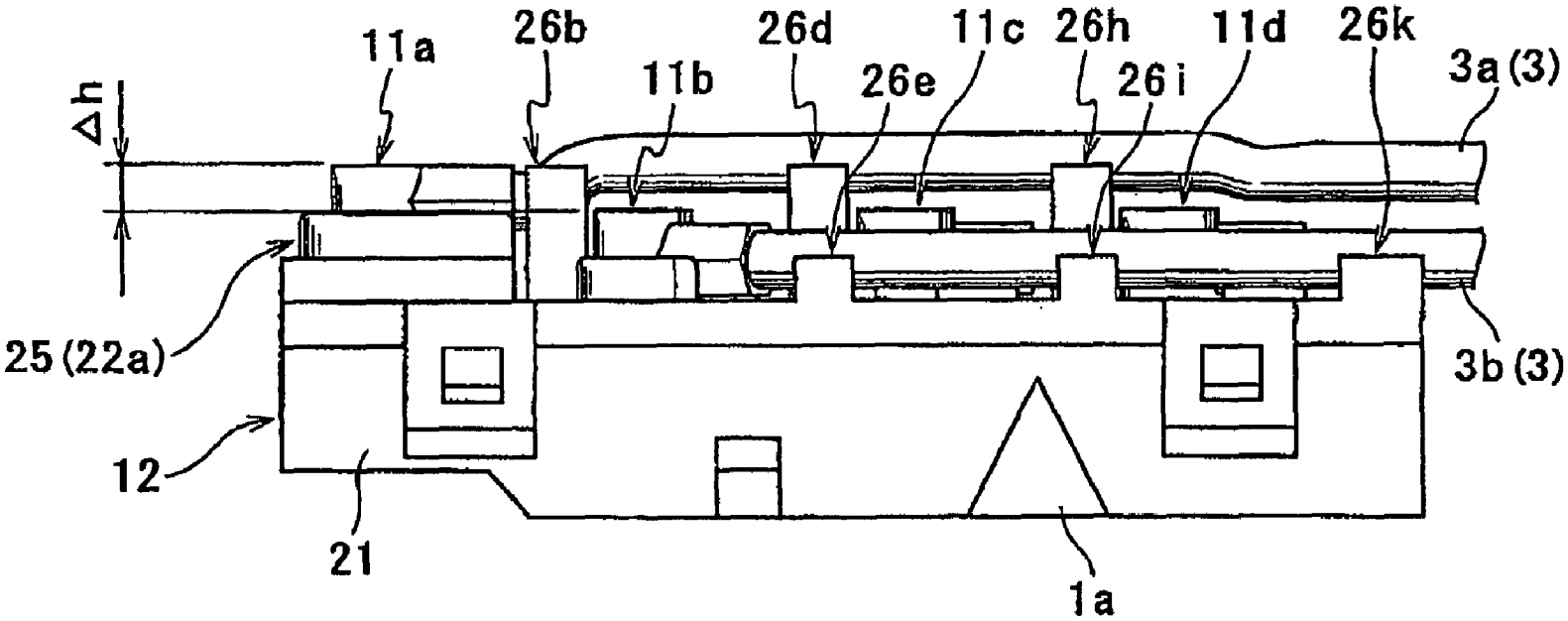
FIG. 8 is a front view showing the connecting housing element shown in FIG. 6A.

In addition, FIG. 8 is a front view of connecting housing element 12 in the state where all connection terminals 11 to which wires 3 have been connected are attached. As shown in this FIG. 8, connection terminal 11*a* that is connected to wire 3*a* which is placed on the upper step side in the stacked arrangement in step form is supported by terminal supporting part 22*a* so as to be positioned on the upper step side relative to connection terminals 11*b*, 11*c* and 11*d* that are connected to wires 3*b* or the like, which are placed on the lower step side of the arrangement. That is, a step is provided so that a height difference Ah is caused between the upper surface (flat surface on the upper step side) of connection terminal 11*a* that is placed on the upper step side and the upper surface of connection terminals 11*b*, 11*c* and 11*d*, that are placed on the lower step side.

Figure 9A:
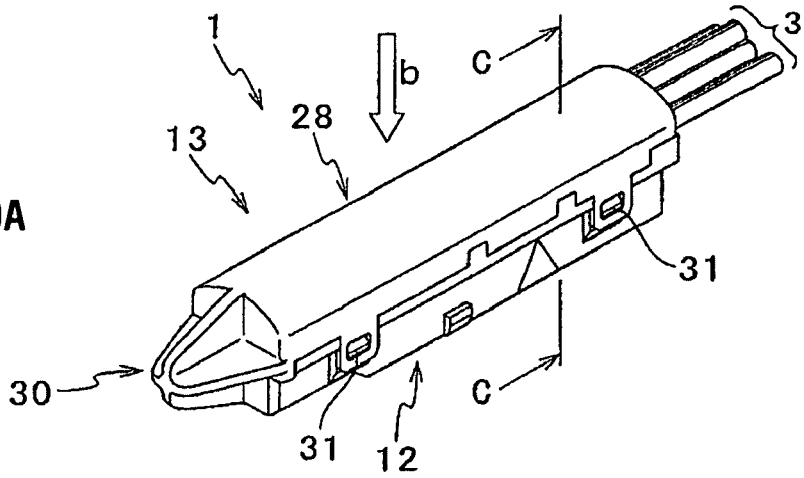
FIG. 9A is a perspective diagram showing the electrical connecting device shown in FIG. 1.
Figure 9B:
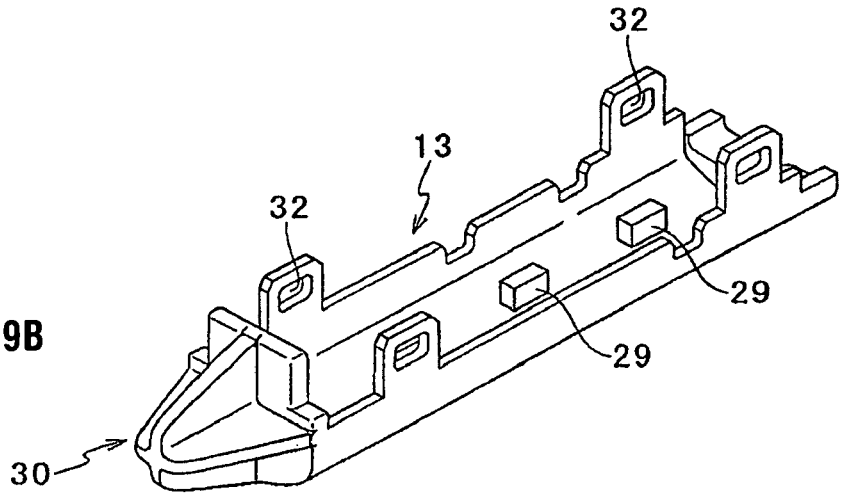
FIG. 9B is a perspective view showing the cover element shown in FIG. 9A.
Figure 9C:
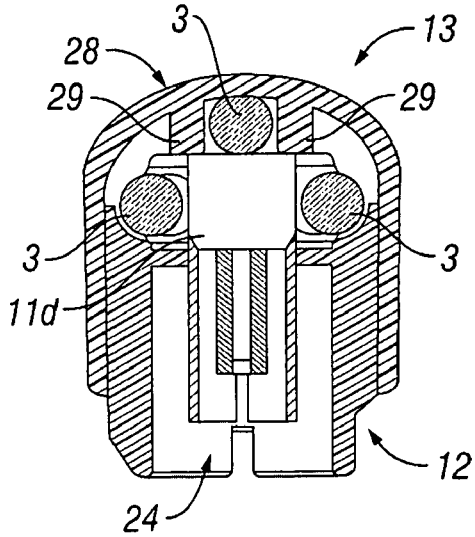
FIG. 9C is a cross sectional view along line C—C of FIG. 9A.

FIG. 9 are a perspective view showing electrical connecting device 1 (FIG. 9A), a perspective view showing cover element 13 of which the side that is attached to connecting housing element 12 faces upward (FIG. 9B), and a cross sectional view along line C—C of FIG. 9A (FIG. 9C). Here, FIG. 9C shows a cross section of connection terminal 11*d* of which a portion has been cut out. As shown in FIG. 9A, cover element 13 is engaged with housing element 12 in the direction of arrow b in the figure (see FIG. 3), and is attached so as to cover connection terminals 11. Here, engagement recesses 32 (see FIG. 9B) for engagement with engagement protrusions 31 (see FIG. 6A and FIG. 9A) that have been provided on the surface surrounding connecting housing element 12 are created in cover element 13. Thus, when cover element 13 is attached to connecting housing element 12, engagement protrusions 31 and engagement recesses 32 become engaged, and thereby, cover element 13 can be held by connecting housing element 12 without fail. In addition, as shown in FIG. 9A and FIG. 9C, this cover element 13 is provided with a curved lid portion 28 that has been formed in a circular arc form in the cross section perpendicular to the direction in which wires 3 are arranged in a parallel manner by means of wire supporting parts 23 of connecting housing element 12. As described above, respective wires 3 are arranged in chevron form and stacked in step form on connecting housing element 12, and such arrangement in step form allows wires 3 of four poles to be densely arranged inside round lid portion 28.

In addition, as shown in FIG. 9B and FIG. 9C, cover element 13 is provided with restricting parts 29 which restrict movement of connection terminals 11 toward the cover element 13 side in the space between this cover element 13 and connecting housing element 12 when cover element 13 is attached to connecting housing element 12. These restricting parts 29 are formed so as to protrude from a number of places toward the connecting housing element 12 side to which cover element 13 is attached. Thus, these restricting parts 29 make contact with connection terminals 11 when cover element 13 is attached to connecting housing element 12, and thereby, movement of theses connection terminals 11 is restricted. Restricting parts 29 are provided as described above, and thereby, the positions of connection terminals 11 can be secured in the direction in which the connector is engaged (see FIG. 5) at the same time as cover element 13 is attached, and thus, connection terminals 11 can be prevented from being supported in an inappropriate state (being inserted halfway).

In addition, as shown in FIG. 9A and FIG. 9B, cover element 13 is formed in a manner where an end 30 on the front end side that is opposite the side from which wires 3 lead out from this cover element 13 is tapered toward its front end side, and formed in a manner where the cross section perpendicular to the direction toward its front end side is in cross form. End 30 is formed so as to be tapered toward its end side in the above-described manner, and thereby, insertion into roof hole 6 can be smoothly and easily carried out. In addition, the cross section is in cross form, and thereby, strength against impacts that work in the direction of twisting the tapered end 30 is secured, and the occurrence of damage in end 30 can be prevented, even in the case where end 30 collides with the edge portion of roof hole 6 in such a manner as to receive an impact at the time of insertion into roof hole 6.

In addition, the form of the end on the side from which wires 3 lead out and the form of end 30 on the side opposite this side from which wires lead out are different from each other in cover element 13. Therefore, the direction of attachment of cover element 13 to connecting housing element 12 can be limited to one direction. As a result of this, incorrect connections can be prevented at the time of assembly of electrical connecting device 1.

Figure 10:
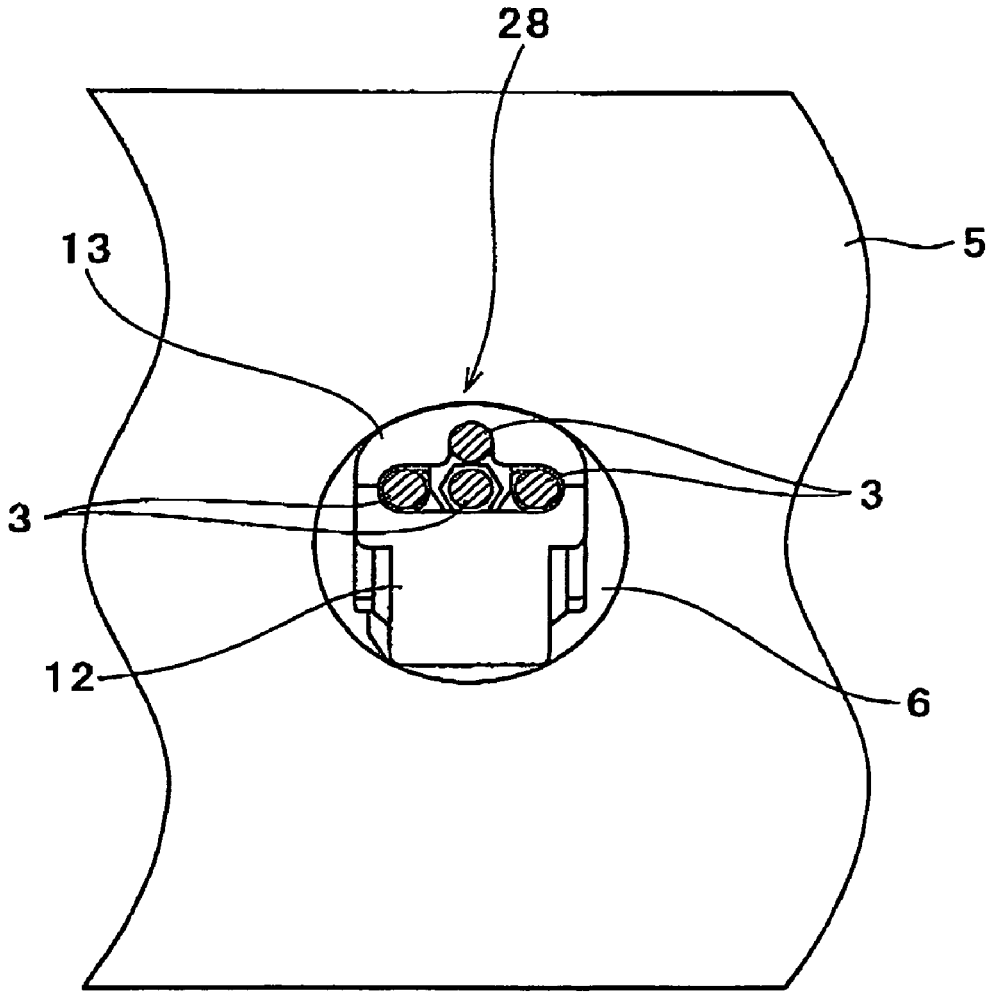
FIG. 10 is a diagram showing the state where the assembled electrical connecting device has been inserted into a hole in the roof of an automobile.

In electrical connecting device 1 described above, bent part 17 is formed in a connection terminal 11 between terminal connecting part 15 and wire connecting part 16 in a manner where a wire 3 that is connected to wire connecting part 16 is arranged in the direction parallel to the direction in which terminal connecting parts 15 are arranged in rectilinear form. Therefore, wires 3, each of which is parallel to the rest, can be arranged so as to be bundled, and the space where wires 3 are arranged can be reduced. That is, an increase in the size of the electrical connecting device caused by the pitch of terminal connecting parts 15 which are aligned can be largely avoided, and miniaturization of the electrical connecting device can be achieved. As a result of this, it becomes convenient to work on a connection within a limited space or through such a space, like work in a narrow space. In addition, electrical connecting device 1 is in a form that extends for a great length in the direction in which terminal connecting parts 15 are arranged in rectilinear form, and therefore, it becomes very convenient, particularly in the case where connection is made after electrical connecting device 1 has been inserted into a hole provided in a wall. That is, the size of this hole can be reduced, and the work of inserting electrical connecting device 1 can be easily carried out. FIG. 10 is a diagram showing electrical connecting device 1 as viewed from the side from which wires 3 lead out in the state where the assembled electrical connecting device 1 has been inserted into roof hole 6. Electrical connecting device 1 can be miniaturized by narrowing the width so that the area of the cross section of the portion which is inserted into roof hole 6 can be reduced, and therefore, as shown in FIG. 10, electrical connecting device 1 can be made to smoothly pass through roof hole 6 having a small opening area. In addition, rounded lid part 28 is formed in cover element 13, and therefore, a portion of the outer periphery of electrical connecting device 1 can have a form that follows the inner periphery of circular roof hole 6. Thus, interference between electrical connecting device 1 and the edge portion of roof hole 6 can be avoided, and miniaturization of the electrical connecting device can be achieved.

Accordingly, in electrical connecting device 1, inconvenience caused by a limitation in the dimensions can be reduced in the case where the mating housing element that supports mating terminals of four or more poles which are aligned in rectilinear form and the electrical connecting device having the connecting housing element which supports the connection terminals of four or more poles that are respectively electrically connected to the respective mating terminals are connected to each other, and thus, miniaturization of the electrical connecting device can be achieved.

In addition, bent part 17 is formed so as to be bent in a right angle in electrical connecting device 1, and therefore, the distance between the line along which terminal connecting parts 15 are aligned and wires 3 which are connected to wire connecting parts 16 and arranged parallel to this line can be reduced. That is, a narrower form of terminal connecting parts 15 in the direction in which these extend and are arranged can be implemented, so that further miniaturization of the electrical connecting device can be achieved.

In addition, in electrical connecting device 1, wires 3 which are connected to wire connecting parts 16 and arranged in a parallel manner are arranged in a manner where the cross sections thereof are stacked in step form, and therefore, wires 3, each of which is parallel to the rest, can be densely arranged so as to be bundled, and the space for arranging wires 3 can be reduced. That is, electrical connecting device 1 can be prevented from spreading in the direction of the width relative to the direction in which terminal connecting parts 16 are arranged, and thus, miniaturization can be achieved.

In addition, in electrical connecting device 1, connection terminal 11*a* that is connected to wire 3*a* which is arranged on the upper step side is supported and located in the step together with the lower step side (with a height difference of $\Delta h$) (see FIG. 8). Therefore, the curvature that occurs as a result of bending of the portion of wire 3*a* on the upper step side between the part which passes above wire 3*b* or the like on the lower side and the part connected to a wire connecting part 16 can be reduced, and the occurrence of damage in wire 3*a* arranged on the upper step side can be prevented.

In addition, in electrical connecting device 1, wires 3 which are connected to wire connecting parts 16 and arranged in a parallel manner can be arranged in a manner where the cross sections thereof are stacked in step form and can be supported so as to be arranged in chevron form and positioned in grid form. Therefore, wire 3*a* on the upper step side can be supported as it is simply by extending a wire supporting part 23 on the lower step side upward, and thus, the structure of wire supporting parts 23 can be simplified in the case where wires 3 are stacked in step form. In addition, terminal connecting parts 15 on the upper step side can be prevented from spreading in the direction of the width relative to the direction in which terminal connecting parts 15 are arranged, and miniaturization of the electrical connecting device can be achieved.

In addition, in electrical connecting device 1, a wire 3 can be engaged between a pair of protrusions 26 and 26 which face each other from among a number of protrusions 26 that have been provided in connecting housing element 12, and thereby, wire 3 can be supported, making the formation of wire supporting parts 23 easy.

Although the preferred embodiments of the present invention are described above, modifications and applications naturally become clarified by reading and understanding the present specification, and such modifications and applications as are included in the claims, as well as meanings that are equivalent to the claims, are intended to be included in the scope of the present invention.

The following modification, for example, may be implemented.

Although in the present embodiment, an electrical connecting device which is connected to a mating housing element after being inserted into a roof hole of an automobile is described, the present invention can be applied in the same manner to a hole that is provided in a place other than the roof. In addition, the present invention can be applied in the same manner even in the case where the electrical connecting device is inserted into a hole that is provided in things other than automobiles. In addition, the present invention can be applied in the case where a connection work is carried out within a limited space, for example, work in a narrow space, without being limited to a case where the electrical connecting device is inserted into a hole.

Although in the present embodiment, the electrical connecting device is described as being used for coaxial wires, the present invention can be applied to wires other than coaxial wires.

Although in the present embodiment, a case where the bent part of a connection terminal is formed to a right angle is described as an example, it is not necessarily bent and formed to a right angle. It may be bent and formed, for example, to have a two-step angle of which each step is approximately 45 degrees.

The forms of the terminal supporting parts and the wire supporting parts which are provided in the connecting housing element may not be the same as those in the present embodiment. That is, the terminal supporting parts may have other forms, as long as they allow terminal connecting parts to be aligned in rectilinear form so that they are connectable to the mating terminals, and the wire supporting parts may have other forms, as long as they support wires in such a manner that the wires are arranged in the direction parallel to the direction in which the terminal connecting parts are arranged in rectilinear form.

Although in the present embodiment, the electrical connecting device which is connected to the connecting housing element that supports the mating terminals of four poles is described, the present invention can be applied in the case of five poles or more. In addition, in the case of five poles or more, the stacked arrangement in step form can be applied in the same manner. Here, although in the present embodiment, a case where the stacked arrangement in step form is an arrangement in chevron form and grid form is described, the present invention can be applied to a stacked arrangement in step form other than that in chevron and grid form.

INDUSTRIAL APPLICABILITY

As is clear from the above description, an electrical connecting device according to the present invention is particularly applicable to the case where the electrical connecting device is used so as to be connected to a mating housing element after being inserted into a hole provided for the insertion of wires between the inside and outside of the automobile. However, broader applications, in addition to this application, are possible for the present invention, and the present invention can be applied in a number of different environments and for a variety of purposes.

The invention claimed is:

1. An electrical connecting device adapted to be connected to a mating housing element that supports mating terminals of at least four poles that are arranged in a parallel manner in rectilinear form, comprising:

connection terminals of at least four poles adapted to be respectively electrically connected to the mating terminals, wherein the connection terminals comprise terminal connecting parts for connection to the mating terminals, and wire connecting parts each connected at a first end thereof to a respective wire and at a second end thereof to a respective terminal connecting part so as to form a bent connection therebetween; and a connecting housing element which has terminal supporting parts for supporting each of the connection terminals in a manner where the terminal connecting parts are arranged in a parallel manner in rectilinear form corresponding to the mating terminals along a wire lead-out direction, and wire supporting parts for supporting each of the respective wires such that the wires are arranged parallel to the wire lead-out direction, the connecting housing element being adapted to engage with the mating housing element.

2. The electrical connecting device according to claim 1, wherein the bent connection forms a right angle.

3. The electrical connecting device according to claim 1, wherein the wire supporting parts are formed so as to support the respective wires in step form, and wherein an upper step is formed on a side of the connecting housing element opposite the terminal connecting parts.

4. The electrical connecting device according to claim 3, wherein the terminal supporting parts further form a lower step below the upper step.

5. The electrical connecting device according to claim 3, wherein the wire supporting parts are formed in a manner where the cross sections of the respective wires are arranged in chevron form, and are respectively positioned in grid form.

6. The electrical connecting device according to claim 1, wherein the wire supporting parts comprise a plurality of protrusions that protrude from the connecting housing element and support a respective wire by engagement between an opposing pair of the plurality of protrusions.

7. The electrical connecting device according to claim 6, wherein the wire supporting parts further comprise a curved form disposed between the opposing pair of the plurality of protrusions.

8. The electrical connecting device according to claim 1, wherein the electrical connecting device is passed through a hole that is provided for the insertion of wires between the inside and outside of an automobile.

* * * * *